US005424489A

United States Patent [19]

Sato et al.

[11] Patent Number: 5,424,489

[45] Date of Patent: Jun. 13, 1995

[54] MAGNETIC BRUSH DEVELOPING APPARATUS

[75] Inventors: Kunihiko Sato, Zama; Sachio Sasaki, Yokohama; Akira Nagahara, Yamato; Shin Araki, Yokohama; Hideaki Iwasaki, Kashiwa, all of Japan

[73] Assignee: Fujitsu Limited, Kanagawa, Japan

[21] Appl. No.: 253,610

[22] Filed: Jun. 3, 1994

Related U.S. Application Data

[63] Continuation of Ser. No. 47,065, Apr. 16, 1993, which is a continuation of Ser. No. 749,759, Aug. 26, 1991.

[30] Foreign Application Priority Data

Sep. 3, 1990 [JP] Japan ..... 2-233906
Sep. 29, 1992 [JP] Japan ..... 4-259241

[51] Int. Cl.[6] ..... G03G 15/09
[52] U.S. Cl. ..... 118/658; 355/251
[58] Field of Search ..... 118/658, 657; 355/251, 355/245

[56] References Cited

U.S. PATENT DOCUMENTS 4,492,456 1/1985 Haneda et al. .
4,825,241 4/1989 Saijo et al. .
4,844,008 7/1989 Sakemi et al. ..... 118/658
4,851,872 7/1989 Murasaki et al. ..... 118/658 X
4,960,070 10/1990 Nishimura ..... 118/658

*Primary Examiner*—R. L. Moses
*Attorney, Agent, or Firm*—Nikaido, Marmelstein, Murray & Oram

[57] ABSTRACT

A magnetic brush developing apparatus includes a development container containing a developer. A magnet is stationarily located in the development container and has magnetic poles radially provided on a plurality of points. A rotational sleeve is arranged to cover the outer circumference of the magnet and is rotatably driven to carry the developer in the development container. A blade is arranged opposite to the rotational sleeve to restrict the amount of the developer which is carried by the rotational sleeve. To obtain a uniform image quality without unevenness among different developing apparatus and a wider range of assembling precision to thus facilitate the installment of the apparatus, at a position facing the developer restriction member, and in its vicinity, there is formed a uniform magnetic flux density section having a magnetic flux density whose vertical component is substantially uniform on the periphery of the rotational sleeve.

24 Claims, 17 Drawing Sheets

Fig. 8

| | | VARIATION RANGE OF MAGNETIC FLUX DENSITY | | | |
|---|---|---|---|---|---|
| | | ±25% OR MORE | ±20% OR LESS | ±15% OR LESS | ±10% OR LESS |
| RANGE FORM MAGNETIC DENSITY SECTION | ±2 DEGREES OR LESS | × | × | × | △ |
| | ±3 DEGREES OR MORE | × | △ | △ | ○ |
| | ±5 DEGREES OR MORE | × | △ | ○ | ○ |
| | ±10 DEGREES OR MORE | △ | ○ | ○ | ◎ |

× POOR ····· GOOD RATIO OF APPARATUS OF 50% OR LESS

△ FAIR ····· GOOD RATIO OF APPARATUS OF 60% OR MORE

○ GOOD ····· GOOD RATIO OF APPARATUS OF 80% OR MORE

◎ EXCELLENT····· GOOD RATIO OF APPARATUS OF APPROXIMATELY 100% IMAGE EVALUATION RESULTS

| MAGNETIC POLE | POLE | STRENGTH OF MAGNETIZATION | WIDTH OF POLE | POSITION OF POLE |
|---|---|---|---|---|
| A | N | 1.8 (kG) | 60° | 0 |
| B | S | ↓ | 30° | 75° |
| C | N | ↓ | 25° | 167.5° |
| D | S | ↓ | 35° | 212.5° |
| E | S | ↓ | 40° | 300° |

| MAGNETIC POLE | POLE | STRENGTH OF MAGNETIZATION | WIDTH OF POLE | POSITION OF POLE |
|---|---|---|---|---|
| A | N | 1.8 (kG) | 60° | 0° |
| B | S | 1.8 (kG) | 30° | 80° |
| C | N | 0.2 (kG) | 15° | 117.5° |
| C | N | 1.8 (kG) | 25° | 157.5° |
| D | S | 1.8 (kG) | 35° | 212.5° |
| E | N | 1.8 (kG) | 40° | 300° |

PRESENT INVENTION

MAGNETIC BRUSH DEVELOPING APPARATUS

This application is a continuation of application Ser. No. 08/047,065, filed Apr. 16, 1993, which is a continuation of application Ser. No. 07/749,759, filed Aug. 26, 1991.

BACKGROUND OF THE INVENTION

1. Field of the Invention

The present invention relates to a magnetic brush developing apparatus for developing an electrostatic latent image, which is used in an electrophotographic recording apparatus or the like.

Widely known as a developing method applicable to a developing apparatus is a two-component magnetic brush developing method using a toner or a colored powder, and a carrier or a magnetic powder as a developer.

The carrier used therein imparts an electrostatic charge to the toner through a triboelectrification or the like thereof, and the toner is held by the electrostatic force for conveyance.

Also, the developing roller functions to convey the developer to the developing section and holds the carrier by the magnetic force for conveyance, and thus the magnetic properties of the developing roller have a great influence on the image quality.

2. Description of the Related Art

The principle of the two-component magnetic brush developing method relevant to the present invention, will now be described with reference to FIG. 18.

A developing roller 1 is constituted of a magnet 1*b* having a plurality of magnetic poles, and a rotational sleeve 1*a* which rotatably covers the surface of the magnet 1*b*.

The magnet 1*b* is usually fixed, and a developer 4 is caught on the surface of the rotational sleeve 1*a*, through the magnetic force exerted by the magnet 1*b*, and carried to a developing section 9 in which a photosensitive drum 3 confronts the developing roller 1*a*, through the rotation of the rotational sleeve 1*a*.

The developer restriction member 2, i.e., a blade is arranged opposite to the developing roller 1 (rotational sleeve 1*a*) to restrict the amount of the developer 4 to be carried to the developing section 9.

The amount of the developer 4 passing through the developer restriction member 2 is determined by the interval (a blade gap) between the developing roller 1 and the developer restriction member 2, and the amount by which the developer head has been raised. Accordingly, the amount of the developer 4 which has passed through the developer restriction member 2 is determined by the height of the developer head.

The image quality is also influenced by the height of the developer head. Namely if the height of the developer is comparatively low and the amount of the developer to be carried to the developing section 9 is thus reduced, sufficient toner for a development is not supplied, which results in a deterioration of the image density. Conversely, if an excessive amount of toner is supplied, the image is unstable.

Namely, a variation in the height of the developer head may cause an instability of the image and a deterioration of the image quality. Accordingly, to eliminate any unevenness of the image quality, it is necessary to maintain the quantity of developer 4 passing through the blade gap of a constant value.

Moreover, even though the blade gap is constant, the quantity of the developer 4 passing through the blade gap is determined by the amount by which the developer resting on the developing roller 1 is raised in the developer restriction member facing section 6.

Therefore, to obtain a firm image quality without unevenness, that condition of the raising of developer head on the developing roller 1 in the developer restriction member facing section 6 should be always the same.

The condition of the raising of the developer is determined by the vertical magnetic flux density at a position opposite to the developer restriction member 2 on the developing roller 1, and as a result, the vertical magnetic flux density at the opposing position must be constant.

FIG. 19 shows the distribution of the vertical component of the magnetic flux density of the conventional developing roller 1. Note, in this specification, the "vertical component of the magnetic flux density" will be hereinafter referred to as "magnetic flux density". The peak portion of the magnetic flux density in the magnetic flux density distribution will be designated as a magnetic pole. This embodiment has five magnetic poles as shown in FIG. 19. The magnetic pole A confronts the photosensitive drum 3, the magnetic poles B, C, and E are mainly used for conveying the developer 4*b*, and a magnetic pole D is mainly used for applying the developer 4 to the developing roller 1. Also, the developer restriction member facing section 6 is positioned between the magnetic poles B and C.

FIG. 20 shows, on an enlarged scale, the distribution of the magnetic flux density of the conventional developer restriction member facing section 6. As clearly shown by the drawing, the conventional developing apparatus suffered from a large change in the vertical component of the magnetic flux density on the developing roller 1 in the developer restriction member facing section 6.

Note, the parts to be mounted in the developing apparatus have respective mounting precision errors which must be allowed for in the fabrication. Namely, if the mounting precision for the developer restriction member 2 is $\pm 0.5$ degrees, if the precision in the magnetized position for the magnet 1*b* is $\pm 3$ degrees, if the fixing precision for the magnet 1*b* $\pm 0.5$ degrees, and if the processing precision of the other parts is $\pm 1$ degree, the position of the developer restriction member 2 relative to the magnetic flux density distribution has a precision as shown by the positional precision range Q. The positional precision range Q is generally within the range of $\pm 5$ degrees of the above-mentioned precision, and becomes 10 degrees in total.

In the conventional developing roller 1, the magnetic flux density in the developer restriction member facing section 6 differs depending on the developing apparatus used, due to the large variation in the magnetic flux density within the positional precision range Q.

As described hereinbefore, the difference in the magnetic flux density causes a variation in the amount of the developer 4 to be carried to the developing section, which has a large affect on the image quality. Accordingly, many different problems arise such as a remarkable difference in the image density depending on the developing apparatus used, a solid, a thin line, a skip in a dots for half torning, and the adherence of the carrier to the photosensitive body.

SUMMARY OF THE INVENTION

An object of the invention is to overcome the conventional disadvantages and to provide a magnetic brush developing apparatus which prevents unevenness in the image quality resulting from a substitution of different developing apparatus, thus leading to an improvement in the image quality, and which has a wider assembly precision range enabling an easy installment of the apparatus.

To achieve the above object, the magnetic brush developing apparatus in accordance with the present invention comprises a developing apparatus containing a developer, a magnet stationarily located in the developing apparatus and having magnetic poles radially provided at a plurality of points. A rotational sleeve is arranged so as to cover the outer circumference of the magnet and is rotationally driven to convey the developer of the developing apparatus. A developer restriction member is arranged opposite to the rotational sleeve to restrict the amount of the developer carried by the rotational sleeve. At the position facing the developer restriction member, and in its vicinity, there is formed a uniform magnetic flux density section having a magnetic flux density having a vertical component. which is substantially uniform on the periphery of the the rotational sleeve.

Further, in the magnetic brush developing apparatus according to the present invention, the uniform magnetic density section may include a distribution of a magnetic flux density having a vertical component which is substantially uniform in a wider range than that of any of a precision in a magnetized position for the magnet, a precision in a mounting of the magnet to the developing apparatus, and a precision in a mounting of the developer restriction member to the developing apparatus. Further, the uniform magnetic flux density section may include a distribution of a magnetic flux density having a vertical component which is substantially uniform in a wider range than that of a precision of a relative mounting position of the uniform magnetic flux density section and of the developer restriction member.

Moreover, the uniform magnetic flux density sections may be provided on both sides of the developer restriction member facing position, to thus extend by an angle of at least 3 degrees, preferably at least 5 degrees, more preferably at least 10 degrees, in terms of the rotational angle of the rotational sleeve.

Furthermore, the uniform magnetic flux density section may have a vertical magnetic flux density within the range of ±20%, preferably ±15%, more preferably ±10% with respect to the preset value for the developer restriction member facing position.

To illustrate the functions of the present invention, FIGS. 17(*a*) and 17(*b*) show the variation in the developer head based on the magnetic flux density distribution of the developer restriction member facing section 6.

FIG. 17(*a*) shows the state of the developer head in the developer restriction member facing section 6 in accordance with the present invention.

In the present invention, the magnetic flux density has a substantially uniform vertical component in the developer restriction facing section 6, so that the condition of raising of the head in this section is substantially uniform.

As a result, even if the mounting position of the developer restriction member with respect to the magnetic flux density distribution is diverged, the condition of raising of the developer is uniform in the developer restriction member facing section 6, so that the amount of the developer 4 to be carried to the, developing section 9 passing through the developer restriction member 2 remains unchanged.

FIG. 17(*b*) shows the state of the developer head in the developer restriction facing section 6 of the prior art. In the conventional techniques, the vertical component of the magnetic flux density is changed in the developer restriction member facing section 6, which causes the variation in the state of the head raising in this section.

Consequently, if the mounting position of the developer restriction member 2 with respect to the magnetic flux density distribution is diverged from the design center value *6a* due to the processing precision of the parts and the like, the head raising of the developer 4 is different in the developer restriction member facing section 6, and thus the amount of the developer 4 to be carried to the developing section passing through the developer restriction member 2 differs depending on the developing apparatus used.

Then, as described earlier, the variation in the amount of the developer 4 influences the image quality, resulting in a different image quality depending on the developing apparatus used.

As described above, in the present invention, a constant uniform image quality can be obtained in an individual developing apparatus, effectively resulting in an improvement in the image quality and a reduction of the processing precision of the parts.

According to the magnetic brush developing apparatus of the present invention, the magnetic flux density in the developer restriction member facing section is almost unchanged even though the relative mounting position is diverged between the magnetic flux density distribution and the developer restriction member, thereby rendering the supply of the developer uniform among different developing devices. As a result, despite the substitution of the developing apparatus, a uniform image quality can be obtained without unevenness, leading to the improvement in the image quality, and a developing apparatus having a wider processing and assembly precision range can be obtained.

BRIEF DESCRIPTION OF THE DRAWINGS

FIG. 8 is a chart showing results of the image evaluation;

DESCRIPTION OF THE PREFERRED EMBODIMENTS

Embodiments of the present invention will now be described with reference to the drawings.

Figure 1:
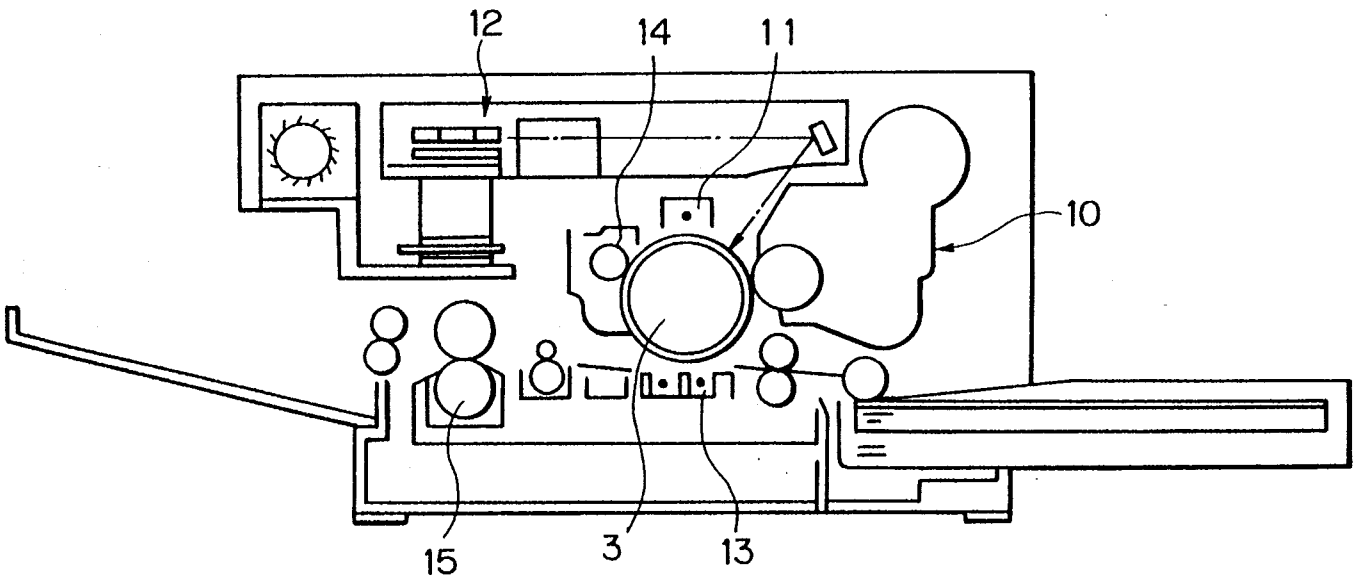
FIG. 1 is a schematic side sectional view of the printer of the embodiment.

FIG. 1 shows an electrophotographic printer. The present invention is widely applicable to not only printers but also copying machines and the like.

In FIG. 1, reference numeral 3 denotes a photosensitive drum rotatable around a shaft thereof, 11 denotes a preelectrostatic charger for electrifying the photosensitive drum 3, 12 represents a light exposure device for exposing the photosensitive drum 3 by a scanned laser beam, to form an electrostatic latent image on the surface of the photosensitive drum 3.

Also, reference numeral 10 represents a magnetic brush developing apparatus for developing the electrostatic latent image formed on the photosensitive drum 3, to form a toner image, 13 designates a transfer device for transferring the toner image onto a printing sheet, 14 designates a cleaner for removing residual toner on the surface of the photosensitive drum 3, and 15 shows a fixing roller for thermally fixing the toner image onto the sheet.

Figure 2:
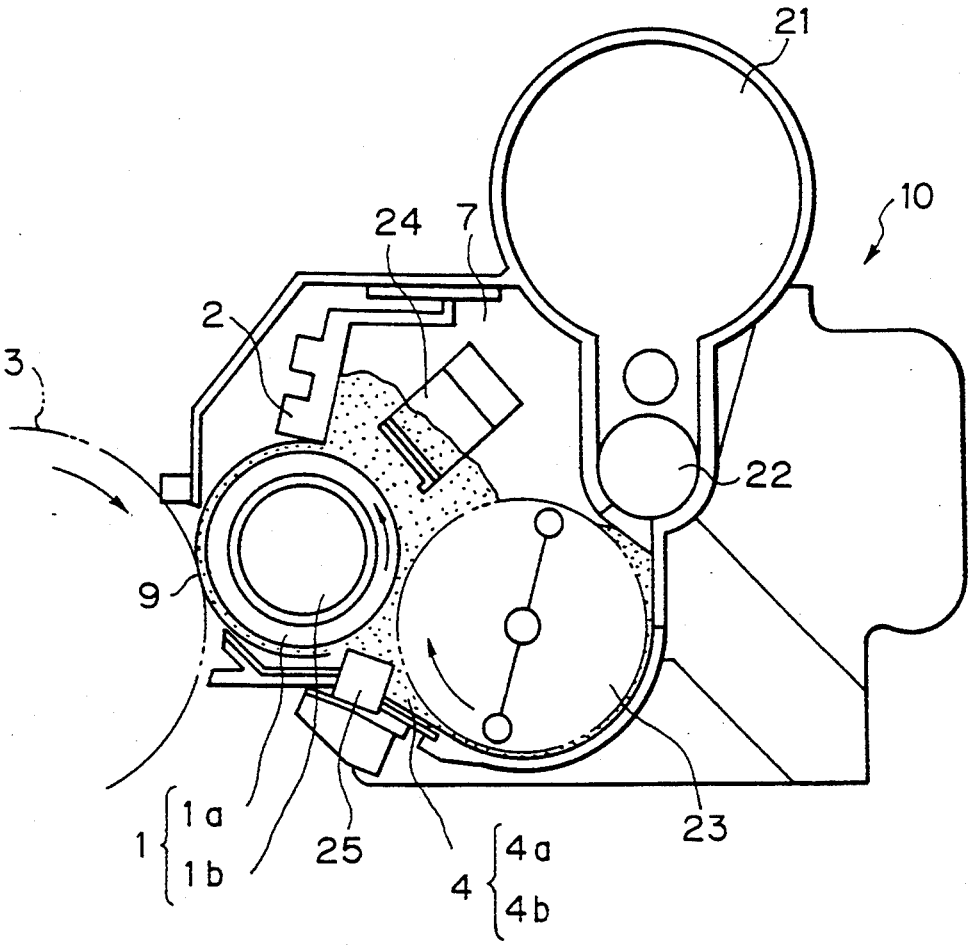
FIG. 2 shows a side sectional view of the developing apparatus of one embodiment.

FIG. 2 shows the developing apparatus 10.

Contained within a development container 7 is a two component developer 4 composed of a toner 4*a*, a colored powder, and a carrier 4*b*, i.e., a magnetic powder. The toner 4*a* is supplied into the development container 7 from a toner hopper 21 provided on the upper portion through a toner supply roller 22.

The toner used in this embodiment is made of styrene acrylic series or polyester series resin and has an average particle diameter of 11 to 12 μm. The carrier, which is a resin-coated magnetic material such as magnetite or ferrite has an average particle diameter of about 100 μm. A saturation magnetization of the carrier is 80 emu/g.

Reference numeral 23 stands for a stirring device for stirring the developer within the development container 7, to produce an electrostatic charge therein. 24 signifies a flow restriction member for returning the developer 4 held back by a developer restriction member 2, to the stirring device 23, and 25 signifies a toner density sensor for detecting a toner density in the developer 4 through a measurement of a permeability of the developer 4, to thereby determine the toner replenishment timing.

The development container 7 has at its left end portion an opening which defines a developing section 9 for developing the surface of the photosensitive drum 3, in which there is provided a developing roller 1 constituted of a cylindrical magnet 1*b* made of a magnetized magnetic material, and a tubular rotational sleeve 1*a* rotatably driven and arranged so as to cover the surface of the magnet 1*b*.

In this embodiment, the magnet 1*b* is made of ferrite and has a shaft made of a non-magnetic material such as aluminum alloy, for example. Also, the rotational sleeve 1*a* is made of the non-magnetic material such as aluminum alloy, for example.

Figure 3:
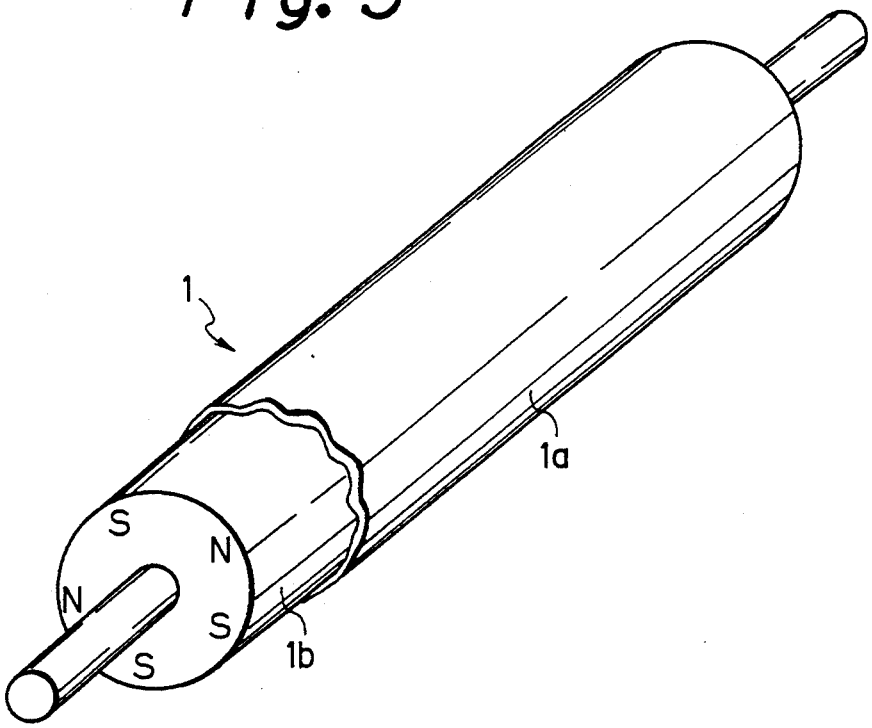
FIG. 3 is a perspective view of the developing roller of the embodiment.

FIG. 3 is a perspective view showing the partially cut-away developing roller 1. The magnet 1*b* shown in FIG. 3 includes a plurality of radially alternately magnetized lines (five lines).

The developer 4 held on the surface of the rotational sleeve 1*a* through a magnetic force exerted by the magnet 1*b*, is carried to the developing section 9 by the rotation of the rotational sleeve 1*a*.

As shown in FIG. 2, a developer restriction member or blade 2 made of a non-magnetized material is rigidly fixed to the development container 7 so as to be parallel to the axial direction of the rotational. sleeve 1*a*. Provided between the developer restriction member 2 and the rotational sleeve 1*a* is a predetermined small gap (1.0 mm in this embodiment), and as a result, the height of the developer 4 (the height of the head) carried by the rotation of the rotational sleeve 1*a* is restricted to a predetermined value by the developer restriction member 2.

Then, only the toner which develops the electrostatic latent image formed on the surface of the photosensitive drum 3 is transmitted to the photosensitive drum 3, and the remaining developer 4 is returned to the development container 7 by the developing roller 1.

Figure 4:
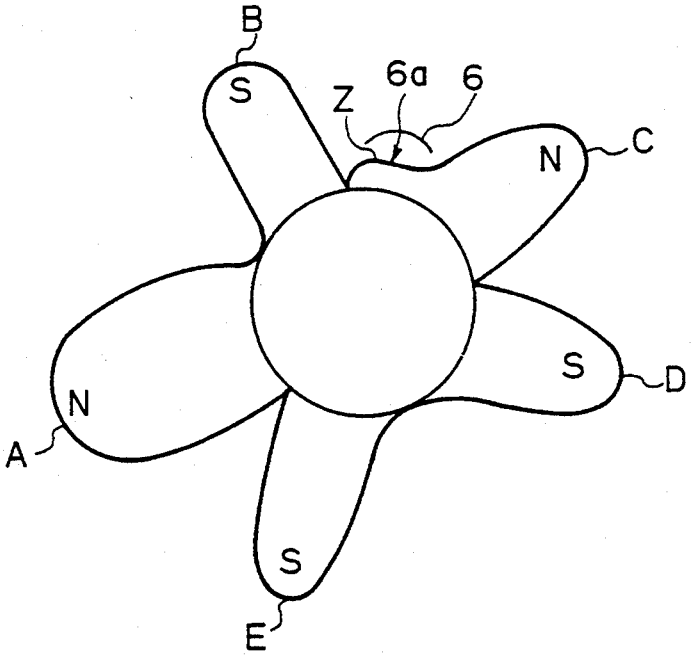
FIG. 4 shows a distribution of the magnetic flux density of the developing roller of the embodiment.

FIG. 4 shows a distribution of the magnetic flux density, in which reference numeral 6 denotes a developer restriction member facing member arranged opposite to the developer restriction member 2.

A magnetic pole A is an N pole confronting the photosensitive drum 3. Magnetic poles B, C, and E are mainly utilized to carry the developer 4, and a magnetic pole D is mainly used to apply the developer 4 to the developing roller 1. Further, the magnetic poles E and D have the same polarity, and therebetween the developer is exfoliated by the developing roller 1. Further, the exfoliated developer 4 is stirred by the stirring device 23 for re-use.

Figure 5:
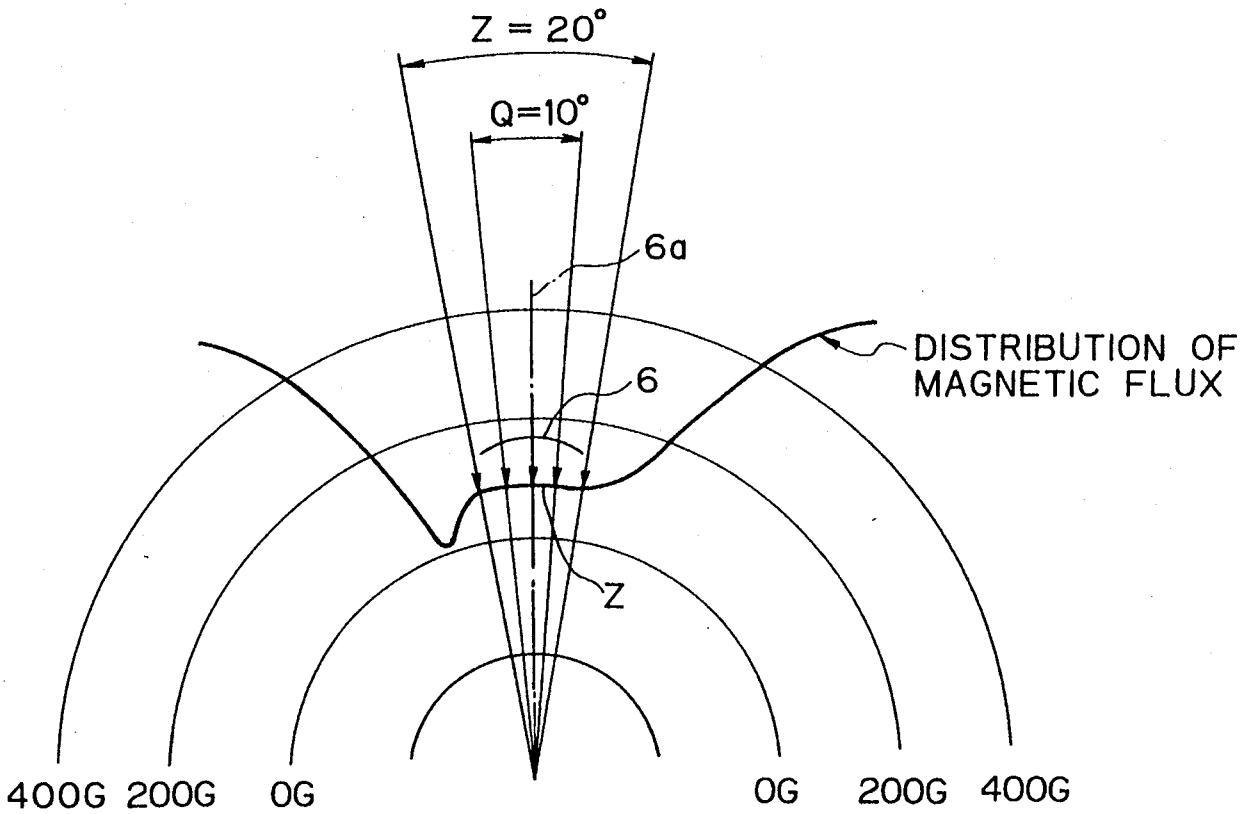
FIG. 5 is a partially enlarged view showing the distribution of the magnetic flux density of the developing roller of the embodiment.

As shown in the enlarged view of FIG. 5, between the magnetic poles B and C the developer restriction member facing section 6 has a substantially uniform magnetic flux density of, for example, 80 to 90 gauss, due to the magnetic pole C.

That magnetic flux density lying between 80 to 90 gauss is suitable to obtain a satisfactory image in the apparatus of this embodiment, the magnitude of which may be appropriately selected depending on the properties of the apparatus.

The uniform magnetic flux density section Z is made to extend across 10 degrees or more and is 20 degrees in total at both sides of the developer restriction member facing the position 6*a* therebetween.

Methods of forming the thus widely spread uniform magnetic flux density section Z will be described later in detail.

As described earlier, the parts mounted in the apparatus have respective mounting precisions (errors permissible in the manufacture) and the like. Accordingly, when the mounting precision of the developer restriction member 2 is ±0.5 degrees, the magnetized positional precision of the magnet 1*b* is ±3 degrees, the fixing precision of the magnet 1*b* is ±0.5 degrees, and the processing precision of the other parts is ±1 degree, the position of the developer restriction member 2 relative to the magnetic flux density distribution of the developing roller 1 includes a precision shown by a positional precision range Q.

Q is on the order of 10 degrees (±5 degrees), and the uniform magnetic flux density section Z is formed so as to be substantially double the Q in this embodiment.

As a result, the magnetic flux density of the developer restriction member facing section 6 is almost unchanged, and accordingly, even if a different developing apparatus is used, the amount of developer 4 supplied to the developing section 9 is unchanged in each developing apparatus.

Figure 6:
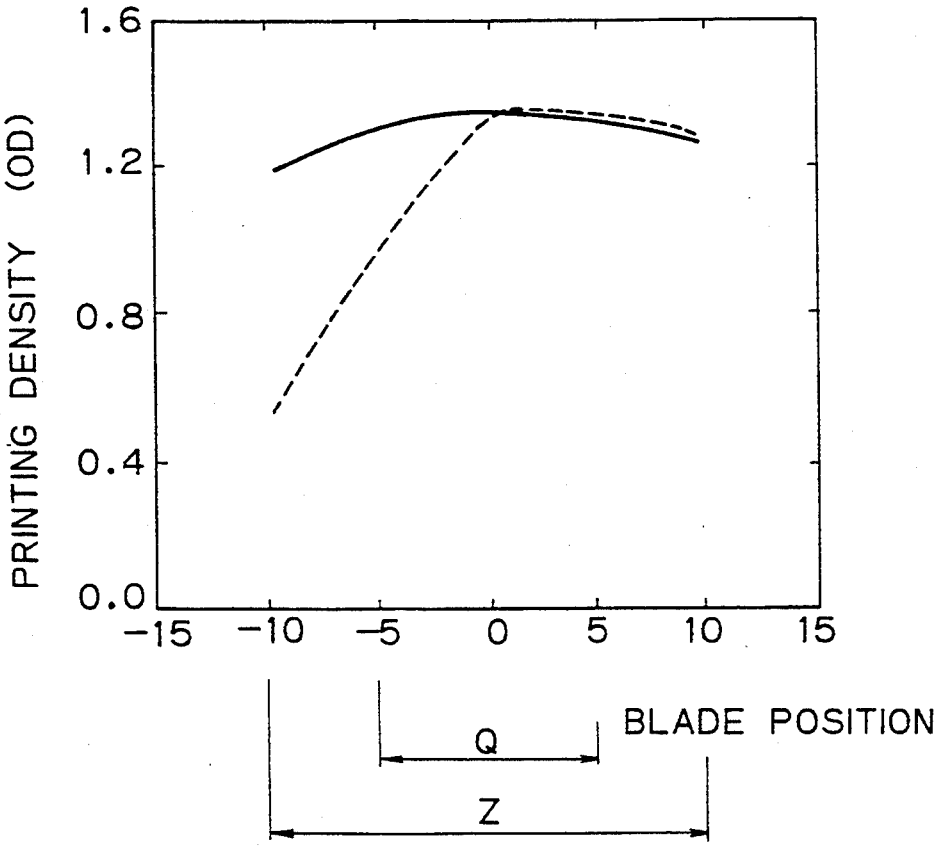
FIG. 6 is a graph showing a relationship between the position of the developer restriction member and the printing density.
Figure 7:
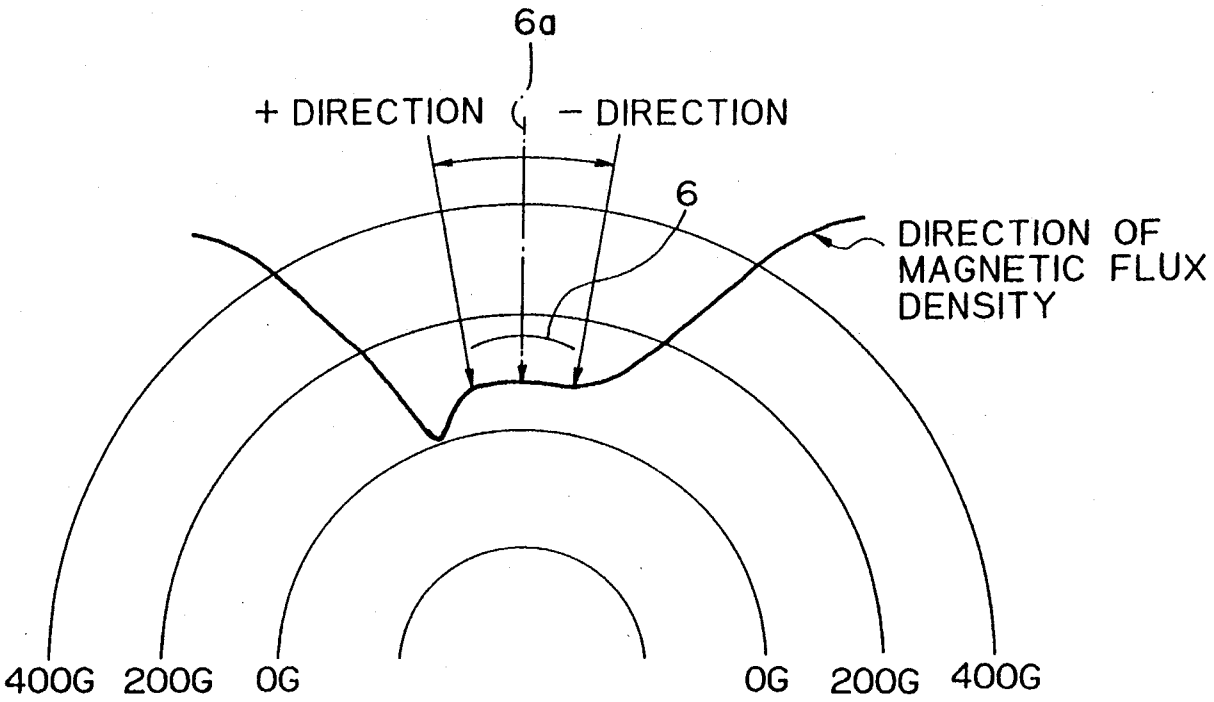
FIG. 7 is a graph showing a relative position of the developer restriction member with regard to the magnetic flux density distribution.

FIG. 6 is a graph showing the relationship between the relative positional variation of the developer restriction member 2 with respect to the magnetic flux density distribution of the developing roller 1, and the printing density (developing density). FIG. 7 shows the + or − direction of the graph. The variation in the relative position of the developer restriction member with respect to the magnetic flux density distribution of the magnet, toward the directions as shown in the drawing, are designated by + and −, respectively.

A solid line in FIG. 6 shows the apparatus of this embodiment, and a broken line shows the conventional apparatus. As can be seen, this embodiment apparatus is subjected to very little change in the printing density regardless of the position of the developer restriction member 2 within the positional precision range Q.

Therefore, each developing apparatus can present a similar uniform image quality within a predetermined range, with respect to the image density, fogging, skip, carrier adhesion and the like.

FIG. 8 shows the angle range for the uniform magnetic flux density section Z of the developing roller used in the developing apparatus, and the ratio of the developing apparatus by which a satisfactory printing can be obtained when the variation range of the magnetic flux density is changed. The image density of a 4 mm square solid of an output image was judged to be satisfactory at 1.2 or over.

In the drawing, o means that the ratio (good ratio of the apparatus) of the developing apparatus at which a satisfactory printing can be obtained is approximately 100%, o means that the ratio (good ratio of the apparatus) of the developing apparatus at which a satisfactory printing can be obtained is 80% or more, Δ signifies that the ratio (good ratio of the apparatus) of the developing apparatus at which a satisfactory printing can be obtained is 60% or more, and x signifies that the ratio (good ratio of the apparatus) of the apparatus at which a satisfactory printing can be obtained is 50% or less. It will be appreciated from FIG. 8 that the developing apparatus using a developing roller having a uniform magnetic flux density section Z with a wider angle range, and having a narrower variation angle of the magnetic flux density within the foregoing angle range, is able to obtain a satisfactory printing with a 1.2 or more image density.

For example, for the developing apparatus using a developing roller (as used in the embodiment in FIG. 6) having an angle range of ±10 degrees or more and having a variation range of the magnetic flux density of ±10 or less, the good ratio of the apparatus was almost 100%, which is an ideal result.

On the contrary, for the developing apparatus using a developing roller having an angle range of +5 degrees or more, and the variation range of the magnetic flux density of ±15% or less, the good ratio of the apparatus was 80% or more, and for the developing apparatus using a developing roller having an angle range of ±3 degrees and the variation range of the magnetic flux density of ±20%, the good ratio of the apparatus was 60% or more.

For the developing apparatus using a developing roller having an angle range of ±2 degree or less and the variation range of the magnetic flux density of ±25%, or more, the good ratio of the apparatus was 50% or less, which is unusable in practice.

Also, in the case of the developing apparatus using a developing roller having an angle range of ±2 degrees or less, and the variation range of the magnetic flux density of +10 or less, as well as the developing apparatus using a developing roller having an angle range of ±10 degrees or more and an variation range of the magnetic flux density of ±25% or more, the good ratio of the apparatus was not less than 60%.

From the above experimental results, it is understood that the uniform magnetic flux density section Z should be formed to extend by 3 degrees, preferably by 5 degrees, more preferably 10 degrees in terms of angle range on both sides of the developer restriction member facing section 6 therebetween, more preferably, a 5 degrees angle range or more, most preferably a 10 degrees angle range or more.

It is also understood that the vertical magnetic flux density of the uniform magnetic flux density section Z should lie within a range of ±20%, preferably ±15%, more preferably ±10% with respect to the preset value at the developer restriction member facing section 6.

In these experiments, 16 kinds of developing rollers were used to measure 20 rollers each.

A description is now given of a method of fabricating a developing roller lying within the angle range and the variation range of the magnetic flux density as described above.

Figure 9:
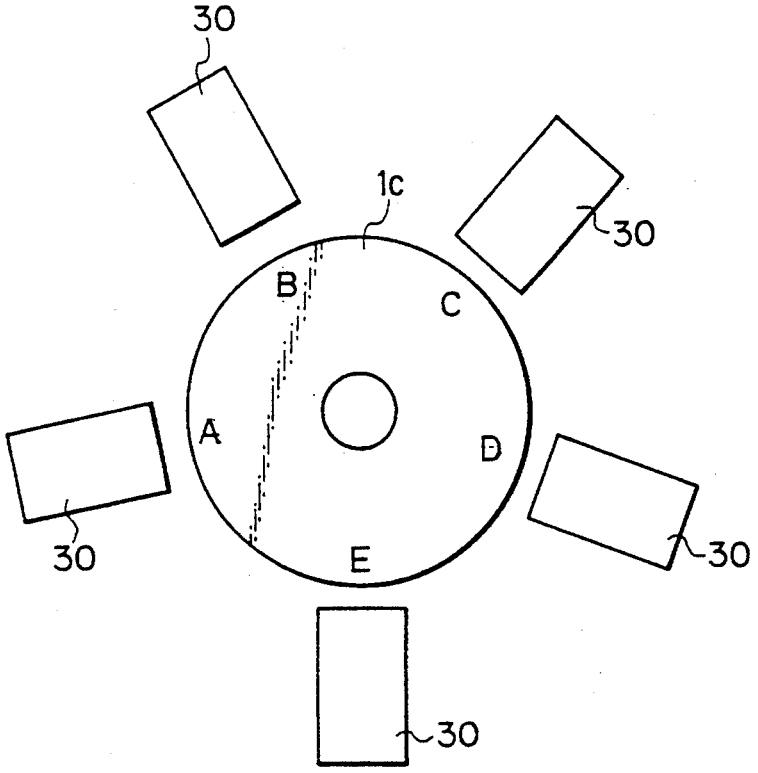
FIG. 9 is an explanatory drawing showing the magnetization principle.

First, the magnetizing of the magnet 1*b* will be described with reference to FIG. 9.

As shown in the drawing, an electromagnet 30 is arranged surrounding a magnet raw material 1*c*. A coil (not shown) of the electromagnet 30 is then energized to exert a magnetic force on the electromagnet 30, to thereby magnetize the magnet raw material 1*c* to form a magnet 1*b*. In this case, the range of the angular position of each magnetic pole is determined by the angular positional arrangement of the electromagnet 30, and the magnitude of the magnetic flux density of each magnetic pole is determined by the current supplied to the coil of the electromagnet 30.

Figure 10:
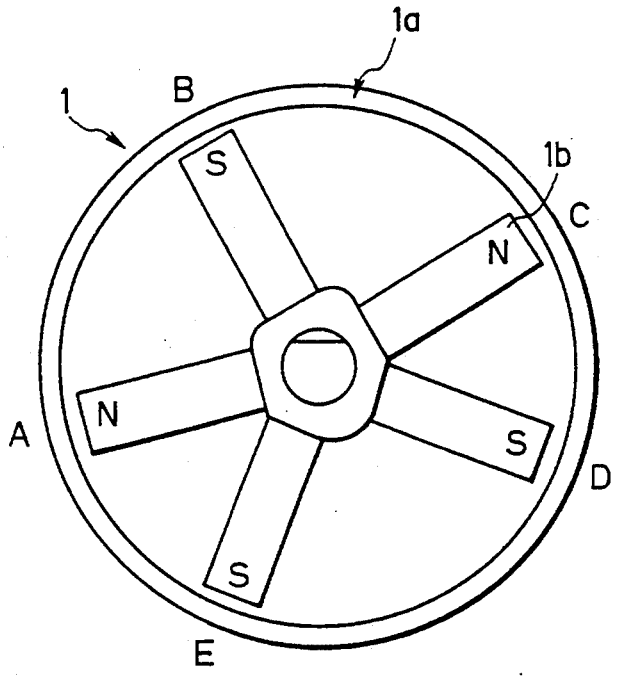
FIG. 10 is a lateral view of the developing roller of another embodiment.

FIG. 10 shows a developing roller of another embodiment in accordance with the present invention. In the drawing, the magnet 1*b* has a shaft having planes to which magnets are attached, and through an appropriate magnetic flux density and the angle arrangement, a satisfactory distribution of the magnetic flux density can be obtained.

Methods of forming a uniform magnetic flux density section Z will now be described with reference to FIGS. 11 to 16.

Figure 11:
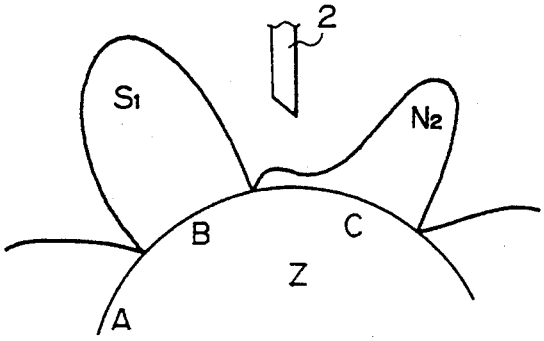
FIG. 11 shows the relationship between the blade and the magnetic poles B and C.

FIG. 11 shows the relationship between the positions of the developer restriction member or blade 2 and the two magnetic poles B and C located on the circumference of the developing roller 1 and between these magnetic poles B and C. There are two methods of forming the uniform magnetic flux density section Z, one being attained by a balance control between the two magnetic poles B and C located between these magnetic poles B and C, and the other being attained by providing a new magnetic pole C′ in the vicinity of the developer restriction member (blade) 2.

Figure 12A:
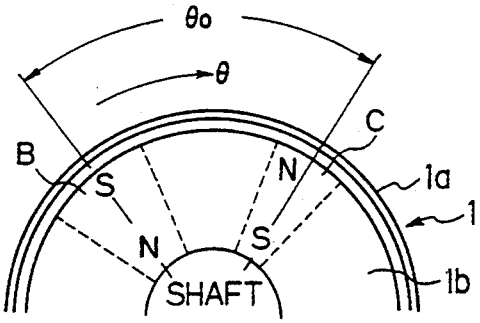
FIGS. 12(*a*) and 12(*b*) show a developing roller and the distribution of the magnetic flux density respectively.
Figure 12B:
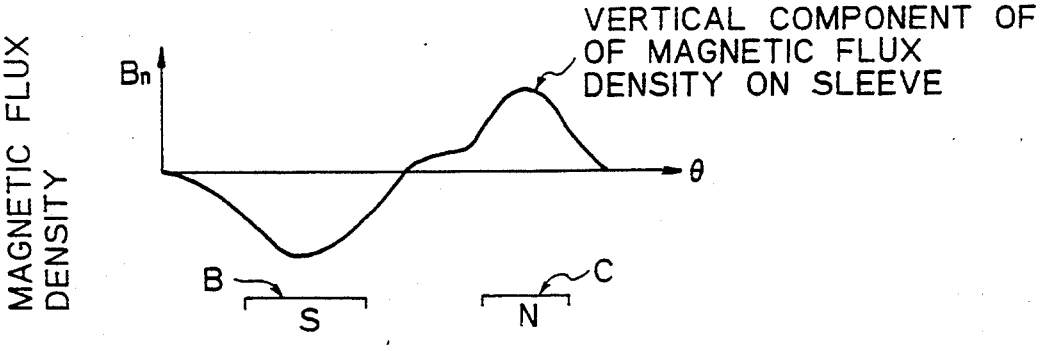

In FIG. 12(*a*) shows a structure of the developing roller and FIG. 12(*b*) shows the vertical component of the magnetic flux density distribution on the rotational sleeve 1*a* of the developing roller 1. As mentioned hereinbefore, the developing roller 1 comprises the rotational sleeve 1*a* and the magnet 1*b*. An isotropic ferrite magnet is used as a material of the magnet 1*b*. As shown in FIG. 12(*a*), if an external magnetic field is exerted on such a magnet material, the magnetic poles (A, B, C, . . . ) are formed. FIG. 12(*b*) shows the results of the measurements of the magnetic flux density distribution on the rotational sleeve 1*a*. The positions of the magnetic poles B and C are shown at the bottom of the drawing. In FIG. 12(*b*), the abscissa indicates an angle $\theta$.

(1) Balance Control of Magnetic Poles

Figure 13A:
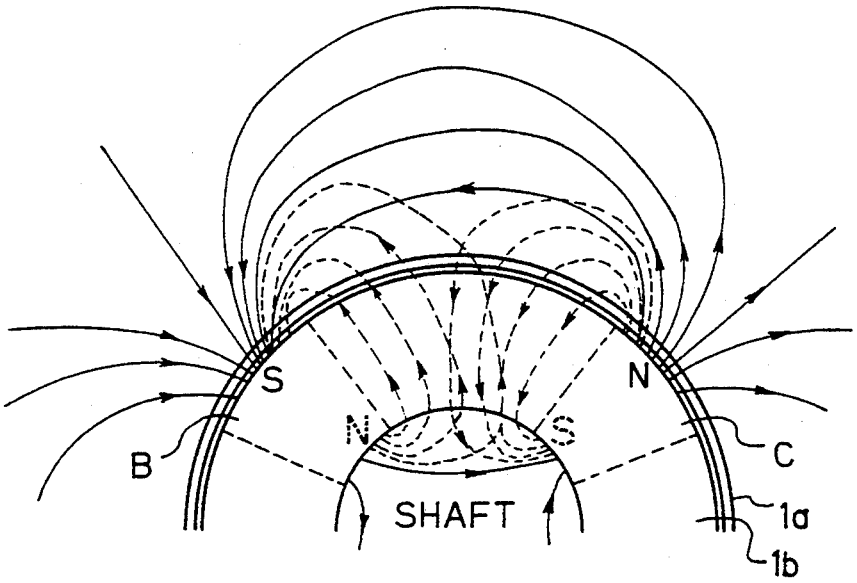
FIGS. 13(*a*)-13(*c*) illustrate a method of forming a uniform magnetic flux density section by a balance control between the two magnetic poles B and C.
Figure 13B:
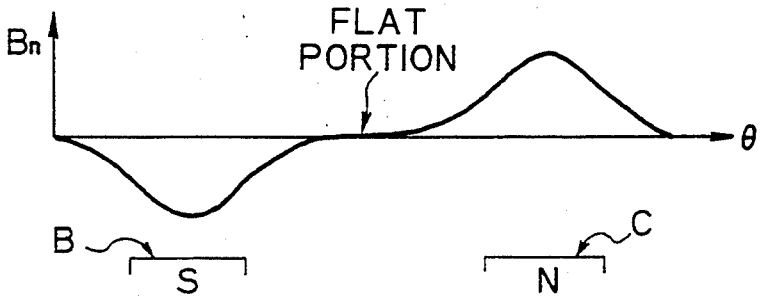
Figure 13C:
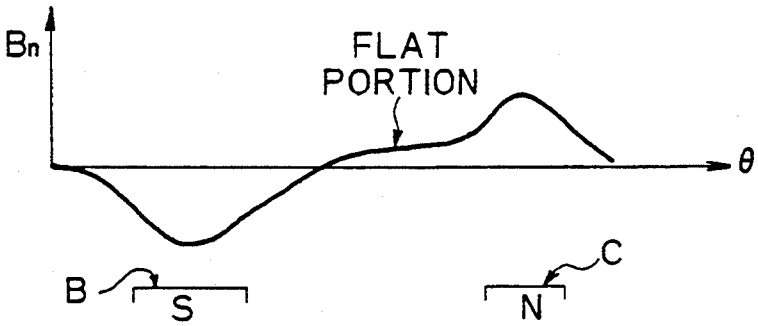

A method of forming an uniform magnetic flux density section Z by a balance control between the two magnetic poles B and C, between which the developer restriction member or blade 2 is arranged is now described. If the distance between the two magnetic poles B and C is increased, as shown in FIG. 13(*a*), not only does the magnetic flux flow from the magnetic pole C (N-pole) toward the magnetic pole B (S-pole), but also the magnetic flux flows toward the inner magnetic poles located at the side of a shaft of the developing roller, as shown by broken lines in FIG. 13(*a*), and thus, both magnetic fluxes are mutually balanced so that a flat portion is formed. If the strength of magnetization and the width of these two magnetic poles B and C are the same, the flat portion is located at a zero line of the magnetic flux density, but if the strength of magnetization of one of the magnetic poles B and C is smaller than that of the other, or if the width of one is narrower than that of the other, the flat portion is not located at the zero line. For example, if the width of the magnetic pole C (N-pole) is narrower, the amount of the magnetic flux around the magnetic pole B (S-pole) is increased, and therefore, the flat portion is moved to the side of N-pole, and thus a uniform magnetic flux density section Z is formed at the side of N-pole, as shown in FIG. 13(*c*).

Therefore, in a method of obtaining a balance control between the two magnetic poles B and C, a uniform magnetic flux density section (flat portion) Z can be advantageously formed if the angle $\theta_0$ (FIG. 12(*a*)) between the center lines of the two magnetic poles B and C is not less than three times the average width of these magnetic poles B and C, and if the width of one of the magnetic poles B and C is smaller (not more than 80%) than that of the other, or the magnetic flux density of one is smaller than that of the other.

(2) Provision of a New Magnetic Pole C′

Figure 14A:
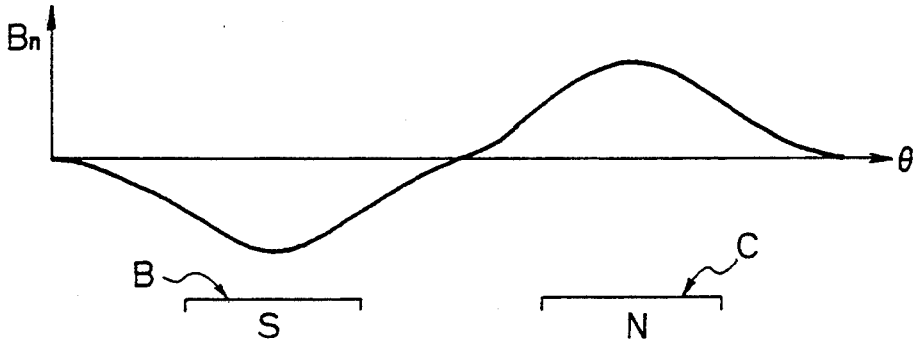
FIGS. 14(*a*)-14(*c*) illustrate another method of forming uniform magnetic flux density section by providing a new magnetic pole C'.
Figure 14B:
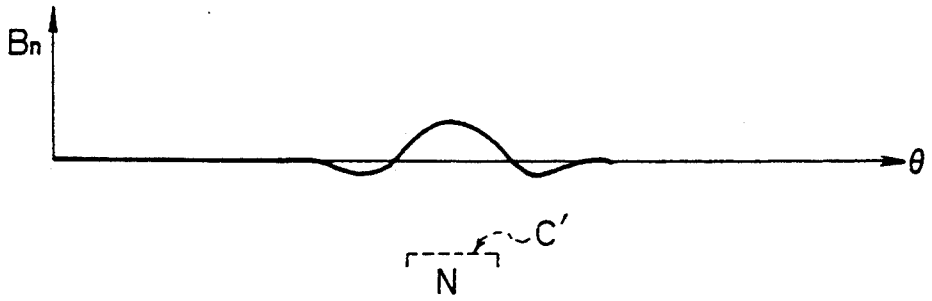
Figure 14C:
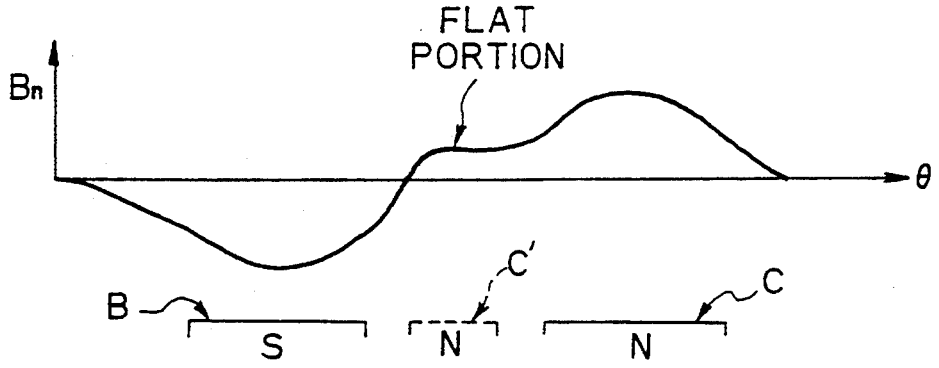

A method of forming a uniform magnetic flux density section Z by providing a new magnetic pole C′ will now be described with reference to FIG. 14. As mentioned above (1), if the distance between the two magnetic poles B and C is increased, a change of the magnetic flux density will be lost and will not be flat, as shown in FIG. 14(*a*). Therefore, a new magnetic pole C′ is arranged between the two magnetic poles B and C and opposite the developer restriction member or blade 2. The distance between the magnetic poles B and C′ is a little bit shorter than the distance between the magnetic poles C′ and C. The width of the magnetic pole C′ is about one half that of the magnetic pole B or C and the strength of magnetization of the magnetic pole C′ is about 5 to 50% that of the magnetic pole B or C. FIG. 14(*b*) shows a distribution of magnetic flux density of this magnetic pole C′ on the rotational sleeve 1*a*. The distribution of magnetic flux density between the magnetic poles B and C is represented as a combination of both, and thus a uniform magnetic flux density section Z is formed, as shown in FIG. 14(*c*).

Therefore, a uniform magnetic flux density section (flat portion) Z can be advantageously formed by providing a new magnetic pole C′, the width of which is about a half that of the magnetic pole B or C and a strength of magnetization thereof is about 5 to 50% of that of the magnetic pole B or C, at a position between the developer restriction member or blade 2 and the two magnetic poles B and C. In this case, the angle $\theta$, (FIG. 12(*a*)) between the center lines of the two magnetic poles B and C is not less than twice the average width of these magnetic-poles B and C.

Figure 15:
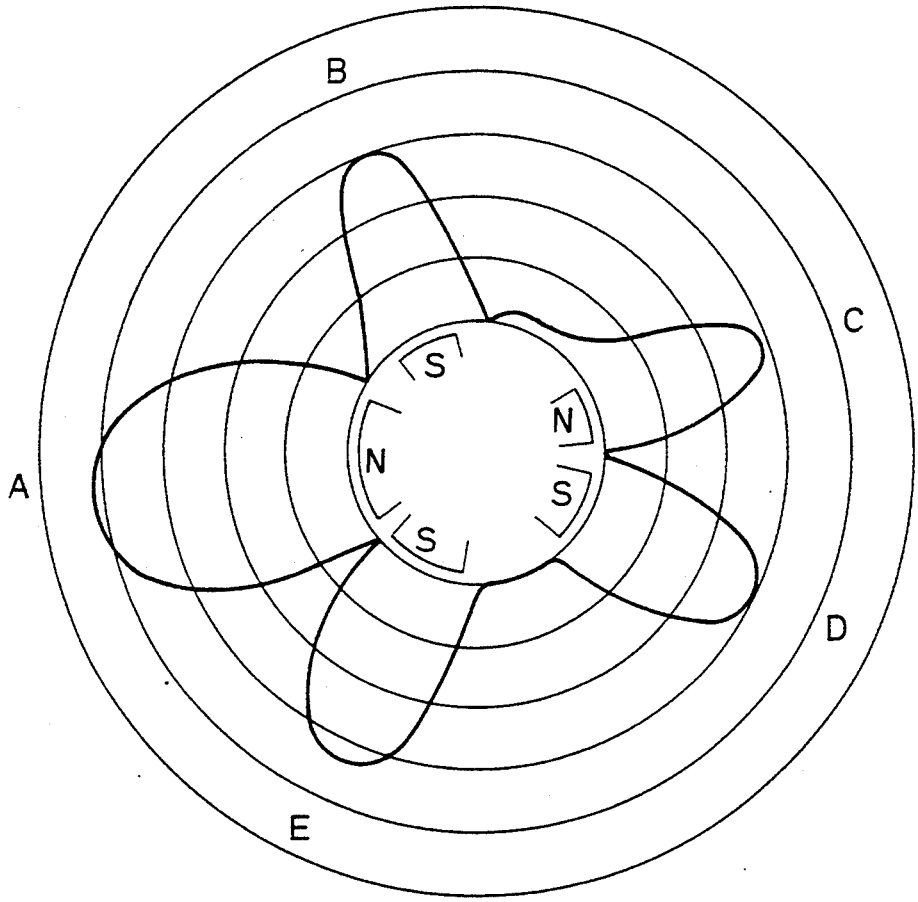
FIG. 15 shows a distribution of the magnetic flux density in the embodiment of FIG. 13.
Figure 16:
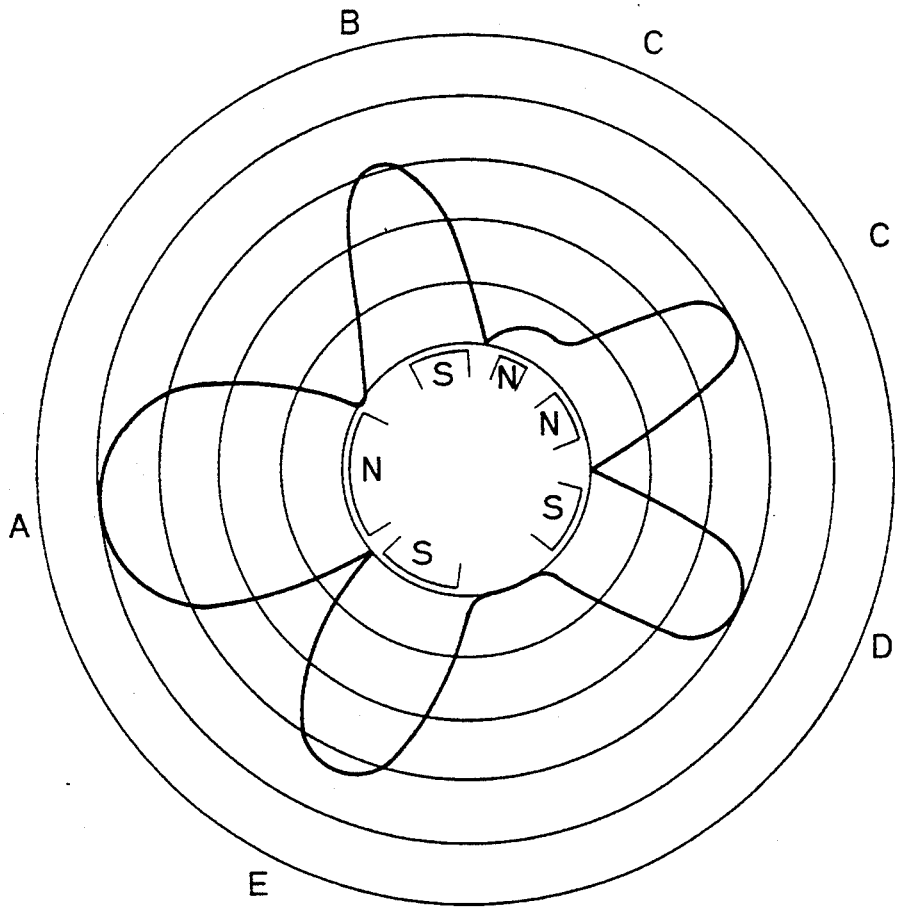
FIG. 16 shows a distribution of the magnetic flux density in the embodiment of FIG. 14.
Figure 17A:
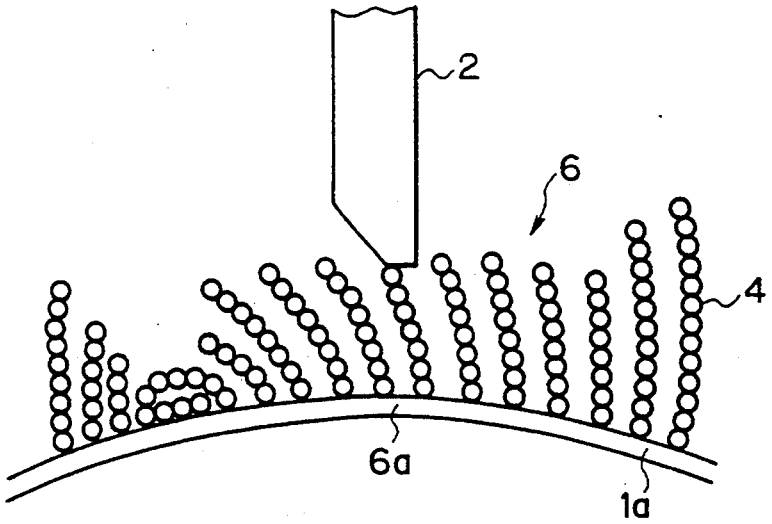
FIGS. 17(*a*) and 17(*b*) are partially enlarged views showing the state of the developer head.
Figure 17B:
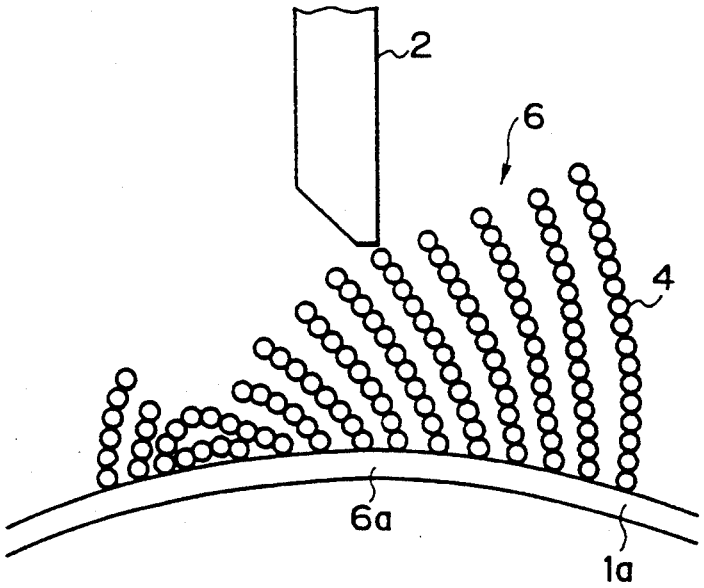
Fig. 17(b) PRIOR ART
Figure 18:
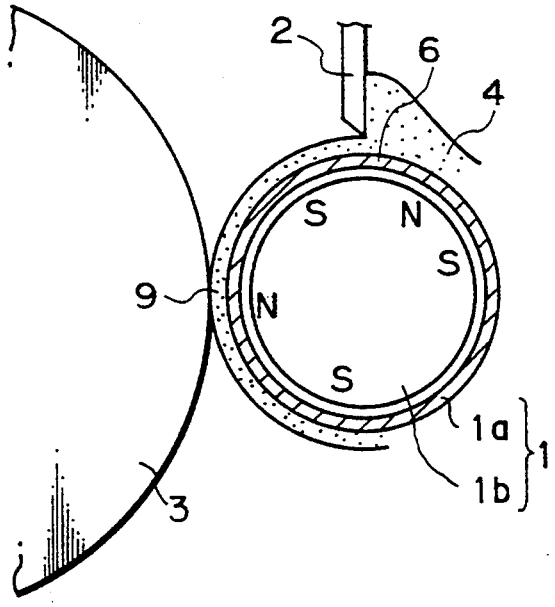
Fig. 18 PRIOR ART
FIG. 18 is an explanatory drawing of the principle of the developing apparatus.
Figure 19:
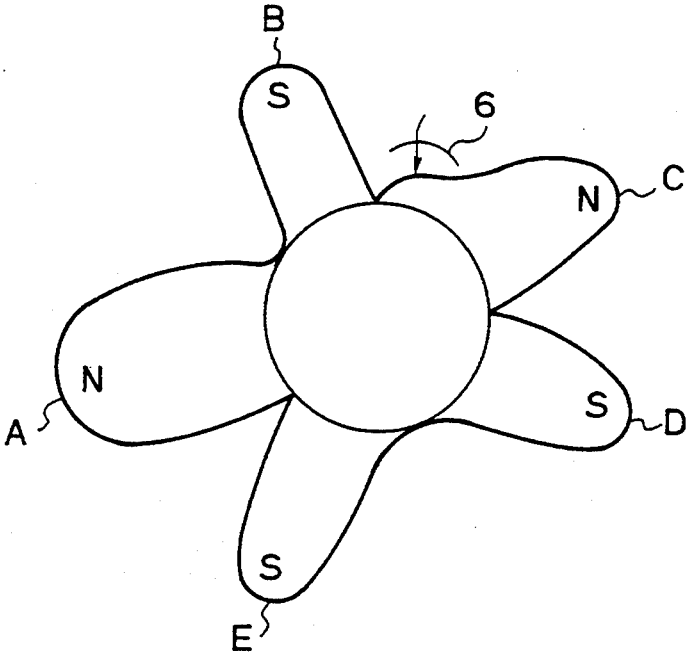
Fig. 19 PRIOR ART
FIG. 19 shows a distribution of the magnetic flux density of the developing roller of the conventional example.
Figure 20:
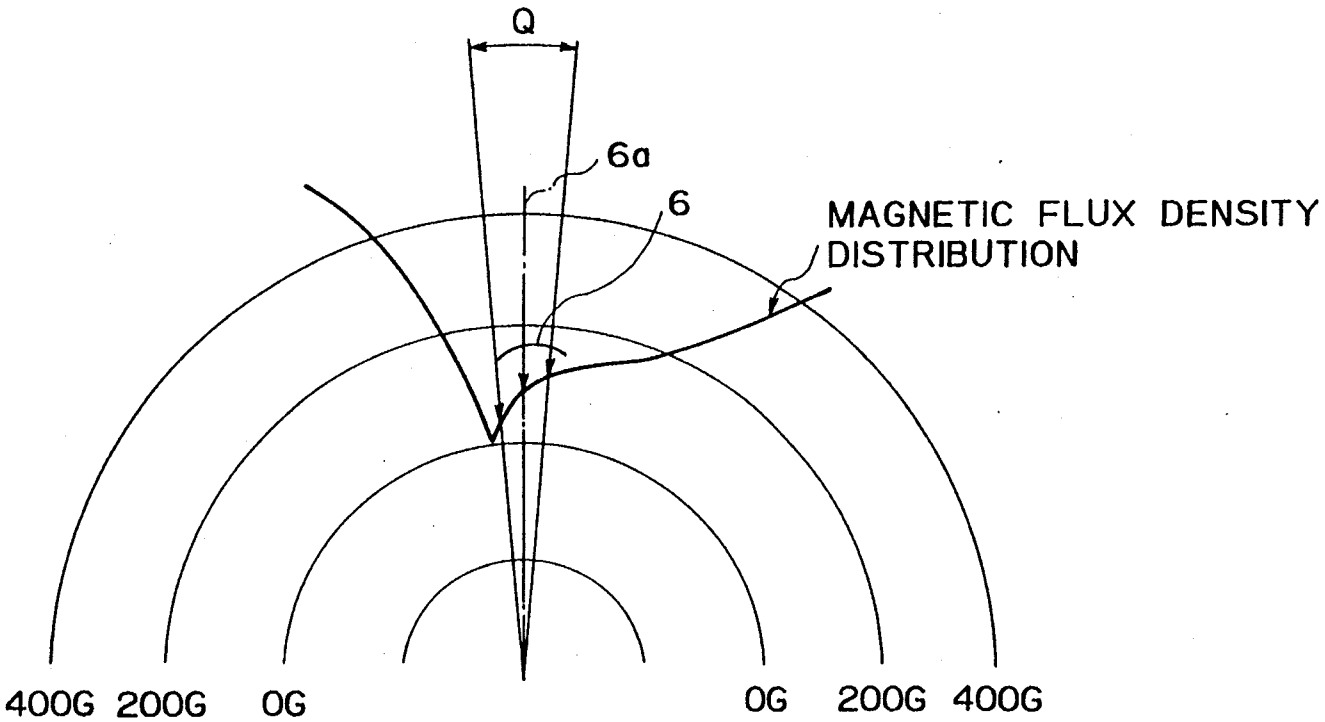
Fig. 20 PRIOR ART
FIG. 20 is a partially enlarged view of the magnetic flux density distribution of the developing roller of the conventional example.

FIGS. 15 and 16 show a distribution of the magnetic flux density in the above-mentioned embodiments (1) and (2), respectively. In FIG. 15, the strength of magnetization of the magnetic poles A, B, C, D and E is the same, but the width thereof is changed as follows. Also the positions of these magnetic poles A, B, C, D and E are set as follows.

| Magnetic pole | Pole | Magnetization strength | Width | Position |
|---|---|---|---|---|
| A | N | 1.8 (KG) | 60° | 0 |
| B | S | same | 30° | 75° |
| C | N | same | 25° | 167.5° |
| D | S | same | 35° | 212.5° |
| E | S | same | 40° | 300.0° |

In FIG. 16, the strength of magnetization and the width of the magnetic poles A, B, C, C′, D and E are set as follows. Also the positions of these magnetic poles are set as follows.

| Magnetic pole | Pole | Magnetization strength | Width | Position |
|---|---|---|---|---|
| A | N | 1.8 (KG) | 60° | 0 |
| B | S | 1.8 (KG) | 30° | 80° |
| C | N | 0.2 (KG) | 15° | 117.5° |
| C′ | N | 1.8 (KG) | 25° | 157.5° |
| D | S | 1.8 (KG) | 35° | 212.5° |
| E | N | 1.8 (KG) | 40° | 300.0° |

It should be noted that the present invention is not confined to the above embodiments. With respect to the uniform magnetic flux density section Z, providing there exists an appropriate magnetic flux density (for example, 80 to 90 gauss) within the range of at least 5 degrees or more, and 10 degrees or more in total on the both sides of the designed developer restriction member facing point *6a* therebetween, the image quality among the apparatuses can be made largely uniform compared to the conventional apparatuses.

Also, the above angle may be made at least 3 degrees or more on both sides thereof, and 6 degrees or more in total, to obtain a better effect.

We claim:

1. A magnetic brush developing apparatus, comprising:

a development container for containing a developer;

a developing roller including a shaft and a magnet stationarily located in said development container and said magnet having inner and outer magnetic poles radially provided on a plurality of points thereof wherein two of said outer magnetic poles are positioned such that a distance between said two outer magnetic poles is spaced such that magnetic flux a) flows from one outer magnetic pole toward the other outer magnetic pole and b) flows from outer magnetic poles toward inner magnetic poles which are located at a side of said shaft wherein magnetic fluxes from each of said two magnetic poles are mutually balanced to form a flat portion therebetween as a uniform magnetic flux density section and said two of said magnetic poles are different from each other;

a rotational sleeve arranged so as to cover an outer circumference of said magnet and rotatably driven to carry the developer of said development container; and a developer restriction member arranged between said two of said magnetic poles and arranged opposite to said rotational sleeve to restrict an amount of the developer carried by said rotational sleeve;

wherein said developer restriction member located at a position facing said uniform magnetic flux density section having a magnetic flux density whose radial component is substantially uniform on a periphery of said rotational sleeve.

2. A magnetic brush developing apparatus according to claim 1, wherein said uniform magnetic flux density section includes a distribution of magnetic flux density whose vertical component is substantially uniform in a wider range than that of any of a magnetized positional precision for said magnet, a mounting precision of said magnet to said development container, and a mounting precision of said developer restriction member to said development container.

3. A magnetic brush developing apparatus according to claim 1, wherein said uniform magnetic flux density section includes a distribution of magnetic flux density whose vertical component is substantially uniform in a wider range than that of a relative mounting positional precision between said uniform magnetic flux density section and said developer restriction member,

4. A magnetic brush developing apparatus according to claim 1, wherein said uniform magnetic flux density section is provided on both sides of said developer restriction member so as to extend by an angle of at least 10 degrees each in terms of a rotational angle of said rotational sleeve.

5. A magnetic brush developing apparatus according to claim 1, wherein said uniform magnetic flux density section has a vertical magnetic flux density lying within a range of ±10% with respect to a preset value for said position of said developer restriction member.

6. A magnetic brush developing apparatus according to claim 1, wherein said uniform magnetic flux density section is provided on both sides of said developer restriction member so as to extend by an angle of at least 3 degrees in terms of a rotation angle of said rotational sleeve, and said uniform magnetic flux density section has a vertical magnetic flux density lying within a range of ±20% with respect to a preset value for said position of said developer restriction member.

7. A magnetic brush developing apparatus according to claim 1, wherein said uniform magnetic flux density section is provided on both sides of said developer restriction member so as to extend by an angle of at least 3 degrees in terms of a rotation angle of said rotational sleeve, and said uniform magnetic flux density section has a vertical magnetic flux density lying within a range of ±10% with respect to a preset value for said position of said developer restriction member.

8. A magnetic brush developing apparatus according to claim 1, wherein said uniform magnetic flux density section is provided on both sides of said developer restriction member so as to extend by an angle of at least 10 degree in terms of a rotation angle of said rotational sleeve, and said uniform magnetic flux density section has a vertical magnetic flux density lying within a range of ±20% with respect to a preset value for said position of said developer restriction member.

9. A magnetic brush developing apparatus according to claim 1, wherein said uniform magnetic flux density section is provided on both sides of said developer restriction member so as to extend by an angle of at least 5 degree in terms of a rotation angle of said rotational sleeve, and said uniform magnetic flux density section has a vertical magnetic flux density lying within a range of ±15% with respect to a preset value for said position of said developer restriction member.

10. A magnetic brush developing apparatus according to claim 1, wherein said developer restriction member is arranged between said two of said magnetic poles, an angle between center lines of said two of said magnetic poles is not less than three times an average width of said two of said magnetic poles, and a width of one of said two of said magnetic poles is smaller than that of the other.

11. A magnetic brush developing apparatus according to claim 1, wherein said developer restriction member is arranged between said two of said magnetic poles, an angle between center lines of said two of said magnetic poles is not less than three times an average width of said two of said magnetic poles, and a magnetic flux density of one is smaller than that of the other.

12. A magnetic brush developing apparatus comprising:

a development container for containing a developer;

a magnet stationarily located in said development container and having magnetic poles radially provided on a plurality of points thereof, wherein two of said magnetic poles, which are different from each other, are positioned such that magnetic fluxes from each pole form a flat portion therebetween as a uniform magnetic flux density section and a third magnetic pole, which is weaker in magnetic flux than said two of said magnetic poles, is arranged at said flat portion between said two of said magnetic poles, said third magnetic pole being a same pole as one of said two of said magnetic poles;

a rotational sleeve arranged so as to cover an outer circumference of said magnet and rotatably driven to carry the developer of said development container; and a developer restriction member arranged opposite to said rotational sleeve to restrict an amount of the developer carried by said rotational sleeve;

wherein said developer restriction member located at a position facing said uniform magnetic flux density section having a magnetic flux density whose radial component is substantially uniform on a periphery of said rotational sleeve, wherein said developer restriction member is arranged between said two of said magnetic poles, an angle between center lines of said two of said magnetic poles is not less than twice an average width of said two of said magnetic poles, and said third magnetic pole, whose width is about a half that of one of said two of said magnetic poles and having a strength of magnetization of about 5 to 50% of that of one of said two of said magnetic poles, at a position between said two of said magnetic poles.

13. A magnetic brush developing apparatus, comprising:

a development container for containing a developer;

a developing roller including a shaft and a magnet stationarily located in said development container and said magnet having inner and outer magnetic poles radially provided on a plurality of points thereof wherein two of said magnetic poles are positioned such that a distance between said two magnetic poles is spaced such that magnetic flux a) flows from one magnetic pole toward the other magnetic pole and b) flows toward inner magnetic poles located at a side of said shaft, a distance between center lines of said two magnetic poles being not less than three times an average width of said two magnetic poles, and a width of one of said two magnetic poles being smaller than that of the other or a magnetic flux density of one of said two magnetic poles being smaller than that of the other, wherein magnetic fluxes from each of said two magnetic poles are mutually balanced to form a flat portion therebetween as a uniform magnetic flux density section and said two of said magnetic poles are different from each other;

a rotational sleeve arranged so as to cover an outer circumference of said magnet and rotatably driven to carry the developer of said development container; and a developer restriction member arranged between said two of said magnetic poles and arranged opposite to said rotational sleeve to restrict an amount of the developer carried by said rotational sleeve;

wherein said developer restriction member located at a position facing said uniform magnetic flux density section having a magnetic flux density whose radial component is substantially uniform on a periphery of said rotational sleeve.

14. A magnetic brush developing apparatus according to claim 13, wherein said uniform magnetic flux density section includes a distribution of magnetic flux density whose vertical component is substantially uniform in a wider range than that of any of a magnetized positional precision for said magnet, a mounting precision of said magnet to said development container, and a mounting precision of said developer restriction member to said development container.

15. A magnetic brush developing apparatus according to claim 13, wherein said uniform magnetic flux density section includes a distribution of magnetic flux density whose vertical component is substantially uniform in a wider range than that of a relative mounting positional precision between said uniform magnetic flux density section and said developer restriction member.

16. A magnetic brush developing apparatus according to claim 13, wherein said uniform magnetic flux density section is provided on both sides of said developer restriction member so as to extend by an angle of at least 10 degrees each in terms of a rotational angle of said rotational sleeve.

17. A magnetic brush developing apparatus according to claim 13, wherein said uniform magnetic flux density section has a vertical magnetic flux density lying within a range of $\pm 10\%$ with respect to a preset value for said position of said developer restriction member.

18. A magnetic brush developing apparatus according to claim 13, wherein said uniform magnetic flux density section is provided on both sides of said developer restriction member so as to extend, by an angle of at least 3 degrees in terms of a rotation angle of said rotational sleeve, and said uniform magnetic flux density section has a vertical magnetic flux density lying within a range of $+20\%$ with respect to a preset value for said position of said developer restriction member.

19. A magnetic brush developing apparatus according to claim 13, wherein said uniform magnetic flux density section is provided on both sides of said developer restriction member so as to extend by an angle of at least 3 degrees in terms of a rotation angle of said rotational sleeve, and said uniform magnetic flux density section has a vertical magnetic flux density lying within a range of $+10\%$ with respect to a preset value for said position of said developer restriction member.

20. A magnetic brush developing apparatus according to claim 13, wherein said uniform magnetic flux density section is provided on both sides of said developer restriction member so as to extend by an angle of at least 10 degree in terms of a rotation angle of said rotational sleeve, and said uniform magnetic flux density section has a vertical magnetic flux density lying within a range of $+20\%$ with respect to a preset value for said position of said developer restriction member.

21. A magnetic brush developing apparatus according to claim 13, wherein said uniform magnetic flux density section is provided on both sides of said developer restriction member so as to extend by an angle of at least 5 degree in terms of a rotation angle of said rotational sleeve, and said uniform magnetic flux density section has a vertical magnetic flux density lying within a range of $+15\%$ with respect to a preset value for said position of said developer restriction member.

22. A magnetic brush developing apparatus according to claim 13, wherein said developer restriction member is arranged between said two of said magnetic poles, an angle between center lines of said two of said magnetic poles is not less than three times an average width of said two of said magnetic poles, and a width of one of said two of said magnetic poles is smaller than that of the other.

23. A magnetic brush developing apparatus according to claim 13, wherein said developer restriction member is arranged between said two of said magnetic poles, an angle between center lines of said two of said magnetic poles is not less than three times an average width of said two of said magnetic poles, and a magnetic flux density of one is smaller than that of the other.

24. A magnetic brush developing apparatus according to claim 13, wherein said developer restriction member is arranged between said two of said magnetic poles, an angle between center lines of said two of said magnetic poles is not less than twice an average width of said two of said magnetic poles, and said third magnetic pole, whose width is about a half that of one of said two of said magnetic poles and having a strength of magnetization of about 5 to 50% of that of one of said two of said magnetic poles, at a position between said two of said magnetic poles.

* * * * *